US006374932B1

(12) United States Patent
Brady

(10) Patent No.: US 6,374,932 B1
(45) Date of Patent: Apr. 23, 2002

(54) HEAT MANAGEMENT DRILLING SYSTEM AND METHOD

(76) Inventor: William J. Brady, 1767 Wishingwell Dr., Creve Coeur, MO (US) 63141

( * ) Notice: Subject to any disclaimer, the term of this patent is extended or adjusted under 35 U.S.C. 154(b) by 0 days.

(21) Appl. No.: 09/543,933

(22) Filed: Apr. 6, 2000

(51) Int. Cl.[7] ..... E21B 10/54

(52) U.S. Cl. ..... 175/428; 76/108.2; 175/393; 175/434

(58) Field of Search ..... 175/393, 427, 175/428, 426, 434; 76/108.2, DIG. 11, DIG. 12

(56) References Cited

U.S. PATENT DOCUMENTS

| | | | | |
|---|---|---|---|---|
| 4,350,215 A | * | 9/1982 | Radtke | 76/108.2 X |
| 4,604,106 A | | 8/1986 | Hall et al. | 51/293 |
| 4,660,444 A | | 4/1987 | Sorensen et al. | 76/108 A |
| 4,867,015 A | | 9/1989 | Kane et al. | 76/108 A |
| 5,007,207 A | | 4/1991 | Phaal | 51/204 |
| 5,120,327 A | | 6/1992 | Dennis | 51/293 |
| 5,303,787 A | | 4/1994 | Brady | 175/430 |
| 5,351,772 A | | 10/1994 | Smith | 175/428 |
| 5,355,969 A | | 10/1994 | Hardy et al. | 175/432 |
| 5,494,477 A | | 2/1996 | Flood et al. | 451/540 |
| 5,535,839 A | | 7/1996 | Brady | 175/427 |
| 5,544,713 A | | 8/1996 | Dennis | 175/434 |
| 5,566,779 A | | 10/1996 | Dennis | 175/426 |
| 5,605,199 A | | 2/1997 | Newton | 175/432 |
| 5,810,103 A | * | 9/1998 | Torbet | 76/108.2 X |
| 5,950,745 A | | 9/1999 | Ingmarsson | 175/420.2 |
| 5,954,147 A | | 9/1999 | Overstreet et al. | 175/374 |
| 5,971,087 A | | 10/1999 | Chaves | 175/432 |
| 5,975,223 A | | 11/1999 | Karlsson | 175/374 |
| 6,026,919 A | | 2/2000 | Thigpen et al. | 175/432 |
| 6,105,694 A | * | 8/2000 | Scott | 175/428 |
| 6,193,001 B1 | * | 2/2001 | Eyre et al. | 76/DIG. 11 |
| 6,220,375 B1 | * | 4/2001 | Butcher et al. | 175/428 |

FOREIGN PATENT DOCUMENTS

| | | |
|---|---|---|
| AU | 202271 | 6/1956 |

OTHER PUBLICATIONS

Jeff Gary, "Deep–Cryogenic Treatment of Steel", Spring 1999, pp. 1–8.

* cited by examiner

*Primary Examiner*—Douglas D. Watts
(74) *Attorney, Agent, or Firm*—R. G. Heywood

(57) ABSTRACT

The invention is embodied in an earth boring tool comprising a bit body having a rotatable working head portion with a cutter element having a wear table of superhard material bonded to a substrate, and wherein the superhard and substrate materials have different coefficient properties creating a stress condition at their interface during bonding and wherein the cutter elements are stress relieved in situ on the bit body by low temperature heat annealing for a preselected time, and in which the cutter elements and bit body head portion are constructed and arranged for heat management in a dry, vacuum drilling operation. The invention further involves the heat management system and method of the stress relief process of heat annealing PCD cutter elements in situ, either alone or with a subsequent cryogenic tempering process.

27 Claims, 3 Drawing Sheets

HEAT MANAGEMENT DRILLING SYSTEM AND METHOD

BACKGROUND OF THE INVENTION

1. Field of the Invention

The invention relates generally to earth boring bits of both the fixed cutter or drag bit variety as used in industry, mining and construction and of the rolling cutter variety used in oil/gas exploration and the like. More specifically, the invention relates to a heat management system and methods for stress relieving cutting tool inserts and for improving drilling performance.

2. Prior Art

Polycrystalline diamond (PCD) is becoming more widely used in making cutting tool inserts. PCD materials are formed of fine diamond powder sintered by intercrystalline bonding under high temperature/high pressure diamond synthesis technology into a predetermined layer or shape;

and such PCD layers are usually bonded to a substrate of "precemented" tungsten carbide to form a polycrystalline diamond compact (PDC)or insert (e.g. cutting element). The term "high density ceramic" (HDC) is sometimes used to refer to a mining tool having an insert with a PCD layer. The term "chemical vapor deposition" (CVD) is a form of pure PCD used for inserts, and "thermally stable product" (TSP) is another form of pure diamond that can be bonded to a carbide substrate or directly to a steel bit body using new vacuum furnace techniques by GE and Sandia Laboratories. Still other superhard surfacing and layered materials, such as "advanced diamond composite (ADC)" and "nitride" compositions of titanium (TiN) and carbon ($C_2N_2$), are gaining acceptance in the mining field. All such superabrasive or superhard materials - PCD, TSP, CVD, ADC and nitride compositions are applicable to the present invention, and the terms "PCD" and "PDC" shall be considered inclusive of all.

The principal types of drill bits used in rotary drilling operations are roller bits and drag bits. In roller bits, rolled cones are secured in sequences on the bit to form cutting teeth to crush and breakup rock and earth material by compressive force as the bit is rotated at the bottom of the bore hold as in oil/gas exploration. In drag bits, PCD or like cutting elements on the bit act to cut or shear the earth material. The action of some flushing medium (fluid drilling mud, water, a compressed air or vacuum system) is important in all types of drilling operations to cool the cutting elements and to flush or transport cuttings away from the cutting site. It is important to remove cuttings to prevent accumulation of debris that will interfere with the continued crushing or cutting action of the bit, and the cooling action is particularly important in the use of PCD cutters to prevent carbon transformation of the diamond material at about 1250° F.

The prior art is replete with various cutting element designs directed by a desire to form structurally stronger, tougher and more wear-resistance and fracture-resistant tools. It is well-known for example, that superabrasive (PCD) cutting elements can fail caused by the fact that the materials comprising the superabrasive portion, or diamond table, and the substrate have different coefficients of thermal expansion, elastic moduli and bulk compressibilities. After formation of such cutting elements by known high temperature and high pressure techniques, the table and substrate materials subsequently shrink at different rates during cooling thereby resulting in internal residual stresses in the superabrasive table, notably in the vicinity of the interface between the table and the substrate. Consequently, the diamond table material tends to be in residually stressed tension while the substrate material tends to be in residually stressed compression prior to being subjected to cutting loads experienced during drilling operations which may result in fracturing of the cutting element. Such residual stresses in the cutting element may also provoke delamination of the table from the substrate or delamination in the table itself under extreme drilling temperatures and pressures. Various solutions have been suggested to address the problems of residual stress and delamination. For instance, cooperating table and substrate configurations thought to address these issues are disclosed in the following literature:

U.S. Pat. No. 4,604,106 to Hall et al

U.S. Pat. No. 5,007,207 to Phaal

U.S. Pat. No. 5,120,327 to Dennis

U.S. Pat. No. 5,351,772 to Smith

U.S. Pat. No. 5,355,969 to Hardy et al

U.S. Pat. No. 5,494,477 to Flood et al

U.S. Pat. No. 5,544,713 to Dennis

U.S. Pat. No. 5,566,779 to Dennis

U.S. Pat. No. 5,605,199 to Newton

When PCD inserts are initially made, the diamond table is highly stressed, as stated, and manufacturers now attempt a stress relief process at about 950° F. Nonetheless, residual stress and insert failure continue to be an industry concern, and the following additional prior art indicates that insert configuration (particularly at the interface) continues to be the primary industry direction.

U.S. Pat. No. 5,950,745 to Ingmarsson

U.S. Pat. No. 5,954,147 to Overstreet et al

U.S. Pat. No. 5,971,081 to Chaves

U.S. Pat. No. 6,026,919 to Thigpen et al

Thus, prior art attempts to incorporate diamond or other super-hard materials as the cutting structure of earth boring tools have presented design and performance problems that heretofore have not been satisfactorily addressed.

My prior U.S. Pat. Nos. 5,180,022; 5,303,787 and 5,383,526 disclose substantial improvements in HCD roof drill bits using PCD cutting elements constructed in a non-coring arrangement, and also teach novel drilling methods that greatly accelerate the speed of drilling action and substantially reduce bit breakage and change-over downtime. These prior HCD non-coring drill bits are capable of drilling over 100–300 holes of 4 foot depth with a single bit and in shorter times with less thrust than the standard carbide bits in hard rock or sandstone formations having a compressive strength of 22,000–28,000 psi. Although these prior HCD bits easily drilled through such earth structures, it was discovered that some drill bits might plug in drilling through mud seams and other soft or broken earth formations and PCD cutting inserts may even shatter in working through stratas of extremely hard or fractured earth conditions believed, in part, to be due to residual stress conditions in the cutting elements. My U.S. Pat. No. 5,535,839 discloses another HCD roof drill bit designed to operate more efficiently in broken and muddy earth formations, but residual stress in these radially domed cutting elements may still shorten the useful life of such tools.

All of these prior HCD drill tools used wet drilling techniques in which substantially quantities of water were employed according to conventional drilling practices. However, comparative tests conducted in three states determined that the amount of water required to wet drill with HCD rotary bits may be reduced from a conventional range of 9–18 gallons per minute down to about 1–3 quarts per minute when atomized into an air mist that effectively scours and cools the PCD cutting inserts of my patented roof drill bits. Thus, my U.S. Pat. No. 5,875,858 discloses a system for greatly reducing the amount of water needed for effective bore hold flushing, although heat management to prevent carbon transformation may still be a problem with some PCD cutting element configurations and, heretofore, vacuum (dry) drilling to evacuate cutting from the drill site has not been a practical option, especially with TSP, PCD and CVD insert tools.

SUMMARY OF THE INVENTION

The invention is embodied in an earth boring tool comprising a bit body having a rotatable working head portion with a cutter element having a wear table of superhard material bonded to a substrate member, and wherein the superhard and substrate materials have different coefficient properties creating a stress condition at their interface during bonding and wherein the cutter elements are stress relieved in situ on the bit body by low temperature annealing for a preselected time, and in which the cutter elements and bit body head portion are constructed and arranged for heat management in a dry, vacuum drilling operation. The invention further involves the heat management system and method of the stress relief process of heat annealing PCD cutter elements in situ, either alone or with a subsequent cryogenic tempering process.

It is the principal object of the present invention to provide an earth boring tool with an improved superhard wear table that will extend the useful life of the tool.

Another important object of the invention is to provide a superabrasive cutter element in which the problem of differential coefficient expansion therein is obviated.

Another object is to provide a bit having a superabrasive wear table constructed and arranged to dissipate the heat generated during boring operations using a dry vacuum process of removing cutting debris.

Another object is to provide a clean bore hole to facilitate heat management and removal of cuttings using a dry vacuum system.

Still another object is to provide a heat management system and method for stress relieving the superhard cutter elements for preventing delamination and other premature failure attributed in the past to such stress conditions.

Still another object is to provide a heat management system and method for constructing and operating superhard surfaced cutter elements permitting drilling with vacuum debris removal systems.

Still another object is to provide an HCD bit using PCD cutting elements and an optimum supporting body, that minimizes torsional stress, prevents heat build-up with either wet or dry drilling techniques, drills faster and reduces respirable dust.

These and still other objects and advantages will become more apparent hereinafter.

BRIEF DESCRIPTION OF THE DRAWINGS

In the accompanying drawings which form a part of this specification, and wherein like numerals refer to like parts wherever they occur.

DESCRIPTION OF THE PREFERRED EMBODIMENTS

The present invention pertains to heat management systems and methods for stress relieving cutter tool elements, especially of the PCD type in which a diamond or like superhard material is bonded as a wear table on a substrate of different material—typically tungsten carbide. Such PCD cutter elements are used on all types of earth boring bits, but rotary drag bits as used in industry, mining and construction are shown and described herein for disclosure purposes. "Heat management", as used herein, is a term that refers to processes for relieving stress conditions occurring between dissimilar materials (having different thermal coefficients of expansion and compression properties) in forming cutter elements and/or bonding them in place on the steel bodies of drag bits or the like. It also pertains to earth boring bits made by such processes, and to the bit cooling process during vacuum drilling.

Figure 1:
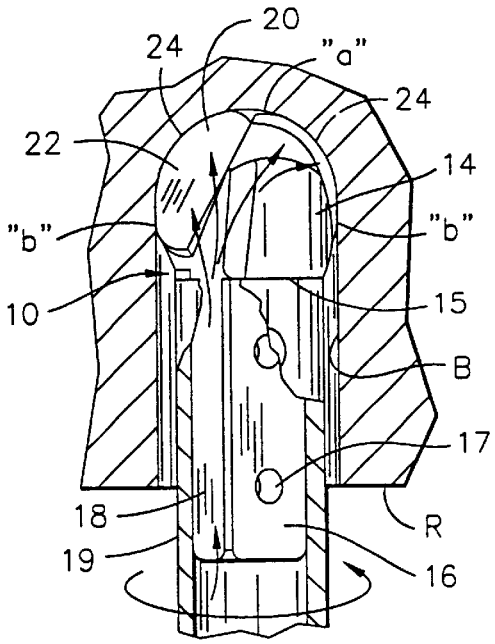
FIG. 1 is a side elevational view, partly broken away, showing a first rotary drill bit useful in the present invention.

FIG. 1 shows one embodiment of my earlier non-coring roof drill bit as taught by my U.S. Pat. No. 5,180,022; 5,303,787 and 5,383,526—the disclosures of which are incorporated by reference herein as though fully set forth. Briefly stated, this non-coring roof drill bit 10 has a steel head portion 14 and shank portion 16 that is typically seated, at 15, on the end of a long rod drive steel 19 of a drilling machine, such as a New Fletcher double boom roof bolter (not shown). The shank 16 and drive steel 19 have a complementary sliding fit and are cross-pinned together, as through bolt holes 17, for co-rotational movement. The shank 16 has vertical water flutes 18 formed on opposite sides for channeling flushing fluids used for cooling and cleaning the cutter inserts 20 of the drill bit 10. These cutter inserts 20 are formed from a PCD disc cut into two semi-round halves and bonded to a substrate of tungsten carbide to form PDC wafers that are then brazed to oppositely facing surfaces of the head portion 14. The wear faces 22 of these inserts 20 both face in the direction of rotation and are positioned at negative rake and skew angles so that the PCD cutter edges 24 perform a slicing action in cutting hard rock or other earthen formations. The effective cutting arc of each insert is about 120° extending from beyond high entry point "a" adjacent to the axis past the gauge cutting outer margin at point "b". The insert 10 is non-coring since the cutter edges of the inserts 20 come substantially together at the axis of the drill bit to define an essentially continuous sinusoidal or S-shaped cutting arc across the diameter of the drill bit tool. This drill bit embodiment is shown drilling bore B in roof top R.

Figure 2:
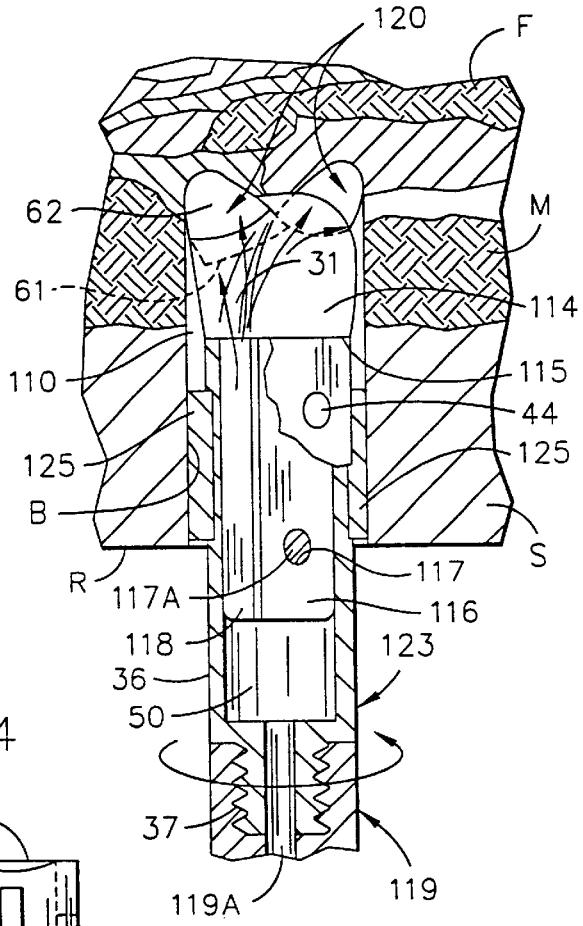
FIG. 2 is another side elevational view, partly broken away, illustrating a second rotary drill bit and a bit coupler.
Figure 3:
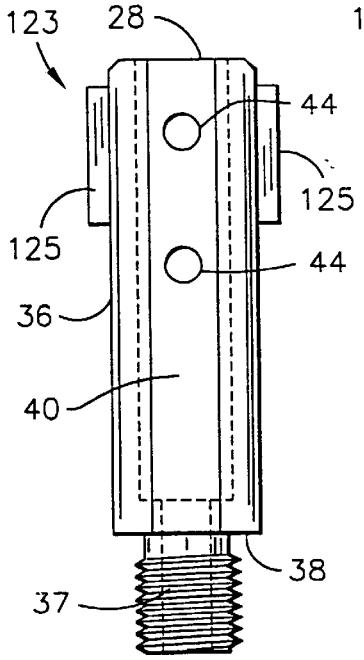
FIG. 3 is a side elevational view of the bit coupler per se.
Figure 4:
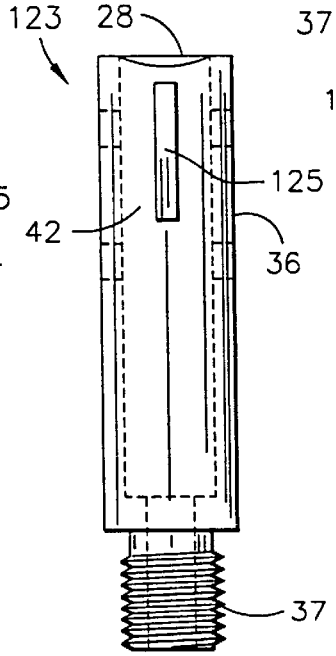
FIG. 4 is a side elevational view of the bit coupler as rotated 90° from FIG. 3.
Figure 5:
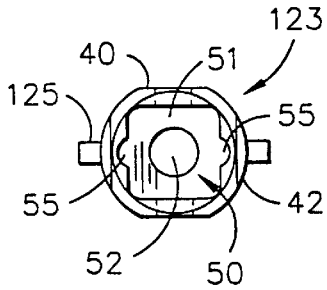
FIG. 5 is a top plan view of the bit coupler.

FIG. 2 shows one embodiment of my earlier coring roof drill bit as taught by my U.S. Pat. No. 5,535,839—the disclosure of which is incorporated by reference herein as though fully set forth. This coring-type drill bit 110 is shown connected through a bit coupler or mounting adapter 123 to a drive steel 119 and operates to drill bore B in the roof R as in a mine or tunnel. The roof top formation in FIG. 2 is lined to illustrate solid rock S, fractured rock or shale F and mud seams M. The drill bit 110 has a steel head mass 114 for seating and supporting superhard surfaced cutter inserts 120, and the bit body has a mounting shank 116 that is removably secured to the drive column of a drilling machine. It will be understood that the drill bit 110 could be connected directly to the drive steel 119 (as in FIG. 1) for co-rotational movement together, but that a mounting adapter or coupler 123 is preferred to obviate rifling, as will appear. Thus, the steel body mass 114 has an annular shoulder 115 adapted to seat against the upper surface 28 of the adapter 123, and the shank portion 116 of this drill bit is also provided with the usual vertical water flutes 118 recessed inwardly on opposite sides of the shank and which serve to channel air/vacuum/liquid flushing fluids for cooling the cutter inserts 120 and cleaning debris away from the cutting area of the tool. The shank 116 of drill bit 110 has cross-bores 117 between opposed flat outer surfaces of the shank to receive fastening pins or bolts 117A.

The bit coupler or mounting adapter 123 may be used with either tool 20, 120 and has an elongate body 36 with a threaded stub 37 on its lower end 38 for removable threaded connection to the upper end of the drive steel 19, 119. The outer body wall of the coupler 123 has opposed flat surfaces 40 for wrench engagement and a pair of arcuate surfaces 42 substantially complementary to the drive steel outer wall, and cross bores 44 are formed in flat walls 40 to match the cross-bores 17, 117 in the drill bit shank 116 and receive the fastening pins therethrough. The coupler 123 permits assembly and disassembly for replacing the drill bit 110 on the drive steel 19/119 with a minimum of unproductive downtime. An important function of the coupler 123 is to accommodate the flow of flushing fluid from the through-bore (119A) of the drive steel to the head mass 14, 114 and cutter inserts 20, 120. To that end the coupler 123 has a central body chamber 50 constructed and arranged to receive the drill bit shank 16, 116 with a sliding fit of the flat opposed shank walls to prevent relative rotation, and the vertical flow of flushing fluid upwardly through the coupler 123 is enhanced by providing vertical water flumes or canals 55 opposite to the shank water flutes 18, 118.

The coring-type drill bit 110 of FIG. 2 has at least two cutter inserts 120, each having a bullet-shaped carbide body with a cylindrical base 61 and an integral radially domed head 62 provided with a superabrasive PCD surfacing material. The PCD inserts 120 are angularly seated in sockets in the head mass 114 so that the axis of each insert is pitched forwardly and outwardly at preselected rake and skew angles relative to the direction of rotation so that the cutter inserts 120 are constructed and arranged on the head mass 114 to cut a predetermined bore gauge size. An important feature of the bit coupler 123 is the provision of bore reamer means 125 constructed and arranged to follow after the cutter inserts (20, 120) to maintain the bore gauge and prevent rifling (i.e. cutting an undersized or grooved hole). The reamer elements 125 are preferably arranged in pairs on opposite outer sides of the bit coupler body 123 to extend from the upper end 28 in an axially extending longitudinal direction, and it will be understood that three or more reamer elements may be utilized. Clearly, the reamer elements 123 project outwardly from the bit coupler side wall and have reamer edges at the same preselected bore-hole gauge as the gauge-margins "b" of the drill bit 10, 110.

In operation, the earth boring bit will be assembled on the drilling machine and rotationally driven into the ground, wall or roof structure and the resulting cuttings should be flushed outwardly by the drilling fluids to clean the bore-hole B. The reamer/bit seat coupler 123 follows into the bore-hole and acts as a secondary drill bit to assure a smooth bore wall and maintain bore gauge. Thus, the reamer bit seat is especially valuable in roof bolting operations to assure that the hole for roof bolts is the proper dimension and not rifled (as most holes currently are), and is clean so that installation of resin and roof bolts is facilitated.

In the first embodiment of FIG. 1 the PDC insert 20 has a planar layer of superhard (PCD, TSP, ADC) material bonded on a substrate of dissimilar material such as tungsten carbide. PDC inserts have a high residual stress from being formed at high temperature and pressure—the diamond table may be formed by using micron sizes of diamond (or graphite) subjected to one million pounds per square inch at moderately high temperatures allowing the diamond or graphite to grow as diamond polycrystals to form the PCD table. This planar table is brazed to or bonded directly on the carbide backing plate and, during this process, the diamond table is stressed or bent due to the relative thermal coefficients of the different materials. The PCD manufacturer stress relieves such parts at about 950° F.

In the second embodiment of FIG. 2 the PCD layer is bonded on a substrate having a radially domed surface so the diamond interface is curved. The same stress relief process is used for curved surfaces as for planar interface inserts even though it appears that there may be a lower stress level in the diamond table (and a stronger, more durable insert) if there are curved or arched surface interfaces than if they are planar.

Figure 11:
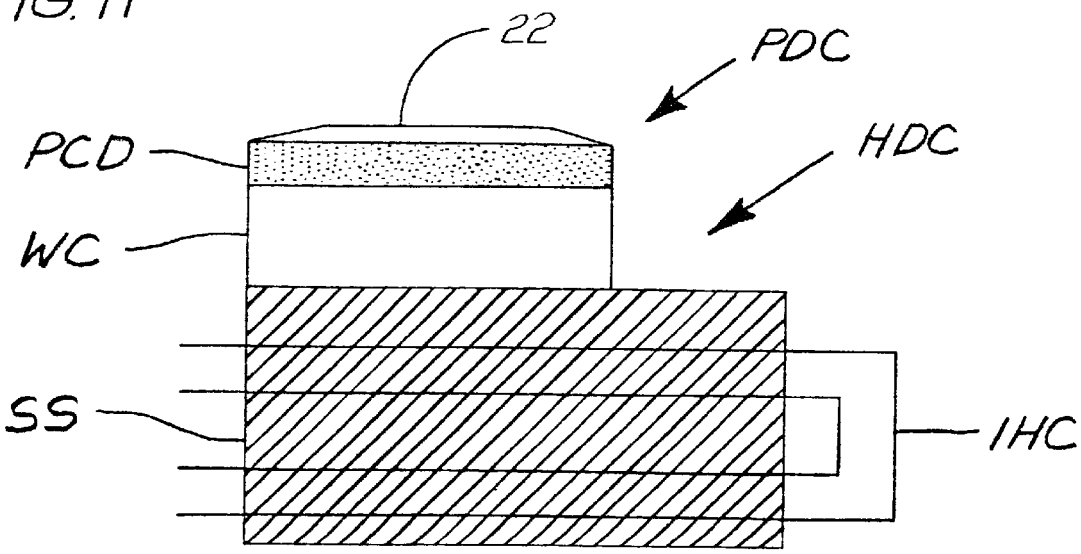
FIG. 11 is a greatly enlarged cross-sectional diagram of a typical diamond compact (PDC) bonded to steel bit body to illustrate the bonding and brazing areas to which the heat management invention pertains.

It should be noted that regardless of the interface configuration and initial stress relief process used on the PDC insert, there still remains a residual stress in the formed diamond table—and the amount of residual stress increases when such inserts (PCD cutting elements) are brazed onto the steel bodies of drag bits or like tools. FIG. 11 diagrammatically illustrates a planar diamond table "PCD" bonded to a carbide substrate "WC" to form an "HDC" or PCD-type cutting tool element "PDC" which, after manufacture and initial stress relief of the insert element, will still retain some amount of residual stress. In assembly on the mounting portion "SS" of the bit body (10)—typically made of 4140 alloy steel—the diamond table is put into tension on the outer (cutter face) surface (22) during the brazing operation because the diamond table PCD is kept cooler than the underlying carbide substrate WC. FIG. 11 illustrates a typical brazing operation in which the steel body is placed in an induction heat coil IHC which heats the steel body SS and adjacent carbide substrate surface area to the optimum brazing temperature, such as about 1175° F. to 1250° F. Even at more extreme brazing temperatures the diamond table must be kept below the carbon transformation temperature of about 1250° F., as will be readily understood. Thus, during brazing the cooler zone of the diamond table PCD does not expand as much as the carbide zone WC and steel body SS and, upon cooling the assembly, the surface of the diamond table is bent or arched because of the different coefficients of expansion and contraction.

The heat management system and process of the present invention takes into consideration the residual stress inherently remaining in the PCD insert after manufacture and the initial stress relief step at about 950° F., as well as the additional stress that results when the diamond table is bent and put in tension during the brazing of a PCD insert onto the steel tool body. It should be noted that diamond is strong under compression loads and very weak under tension loads. It has been discovered that the residual and tension stresses acting on the diamond table of an HDC tool can be reduced to prevent premature breakage and/or delamination and produce a tougher, longer lasting tool.

The heat management method uses a low temperature annealing process after the assembly step of brazing or joining the PCD inserts to the tool body. In this method the tool is preferably heated in an inert (nitrogen or hydrogen) atmosphere for about two hours or more at a temperature in the range of 500° F. to 900° F. and then the tool is slowly cooled as within the furnace chamber. This "hot stress relief process" is effective on PCD diamond/carbide compacts at annealing temperatures as low as 500° F. for a longer period of about 2.5 to 3.0 hours and as high as 900° F. for periods as short as about one hour.

Diamond drill bits can be stress relieved in air (ambient) at the lower temperatures of about 550° F. to 700° F. for longer time periods of 2 to 3 hours with good results, but at elevated temperatures in the range of 800° F. to 900° F. oxidation of the diamond table may result and the hot stress relief process may be carried out in an inert atmosphere for a shorter period. Therefore, most inserts should be hot stress relieved at a minimum temperature of about 500° F., and preferably in the range of 550° F. to 850° F. for 1.5 to 3 hour periods. It takes time for the molecules to re-adjust in solid state form after the stress of brazing so time is important as well as temperature. By increasing the temperature, more stress can be relieved in a shorter time. Some diamond inserts (TSP, PCD and ADC) are brazed directly onto the steel or other metal bit body and these must be stress relieved at about 800° F. for two hours, and then allowed to cool down slowly.

The heat management method using the "hot stress relief process" alone is highly effective in reducing the residual and tension stress in PCD cutting elements and generally sufficient for providing longer lasting and stronger tools for most applications. However, some recent development work has been done in the use of cryogenic tempering as a process for improving the useful life and performance characteristics of various materials, and it has been discovered that such a "cold stress relief process" or "cryo process" following the hot stress relief step may enhance the steel body as well as the diamond table and produce a much tougher drill bit for very hard drilling conditions.

The cryo process comprises the step of lowering the temperature of a heat treated HDC tool down to about −195° C. (−313° F.) and holding it for a period of about 24 hours. This is carried out using liquid nitrogen either by direct immersion or by placing the HDC tool in a cryogenic chiller unit. Typically, HDC tools may be tempered after brazing by a sudden quench in a cold liquid zone, but it has heretofore been unknown to stress relieve the PCD inserts using an intermediate "hot process".

Testing on different PCD insert tools is still being conducted, but preliminary testing indicates that much tougher diamond tables and elimination of delamination problems result from the heat management system using the hot stress relief process alone or preferably with the added cryo process annealing step, as described.

Referring now to FIGS. 6–10, a third presently preferred embodiment is illustrated in the form of an HDC roof drill bit 210 as one of the class or types of rotary drag bits to which the invention pertains. This bit 210 has a tempered steel body 212 constructed and arranged with diametrally opposite dual pillow blocks or heads 214 connected by intermediate section 211 to a mounting base 216 for removably securing the bit 210 to a drilling machine (not shown). It should be noted here that the tool embodiments of FIGS. 1 and 2 are designed for "wet" drilling operations wherein a drilling mud or fluid (water) is circulated across the diamond faces of the PDC cutting elements; whereas the FIGS. 6–10 embodiment is designed for "dry" vacuum drilling using PDC cutting inserts 220.

The drill bit base 212 is connected by a bit coupler or mounting adapter 223 (FIG. 6) to the drive steel column (not shown) of a drilling machine which is constructed and arranged to create a negative pressure or "vacuum" suction pressure in the range of 15"Hg to 24"Hg through the drive column, the mounting adapter 223 and tool base 212 to suction cuttings from the bore hole during cutting operations. The vacuum drill bit 210 has an interior central chamber 213 in the middle and base sections 211, 212—the base section 212 having a hexagonal or like multi-sided interior wall 217 to form a socket non-rotatably receiving the upper end of the adapter 223 and being locked together by a locking clip in port 217A for releasable connection. The intermediate section 211 is an upward continuation of the circular base wall 216, but is cut out on opposite sides to form large openings 211A into the central vacuum chamber 213, FIGS. 6–8. The pillow blocks 214 of the upper head section connect to each other across the top of the steel body 212 and are constructed and arranged to form oppositely facing support surfaces or faces 214A (FIG. 8) to seat the PDC inserts 220. This section is also machined to form curved bottom ledges or sockets 214B which cup and seat the lower margins of the diamond inserts 220. The pillow blocks 214 are spaced apart by a heat gap, at 221, that extends below a horizontal line "b—b" extending across the centers of the two circular inserts 220; and the head section mass in front of the inserts 220 below the sockets 214B form heat sinks 222A for absorbing the body of heat translated or transferred thereto from the diamond table 223 of each insert as this heat is generated during drilling. It is known that diamond material is an excellent conductor of heat and that heat always flows to the coldest zone, and the vacuum bit 210 acts to rapidly dissipate the heat created at the cutting edges 224 of the PCD table. The center portion 211A of the bit body is machined out to leave a large opening to the axial vacuum chamber 217, and the metal around this opening and supporting the PDC cutting element 220 forms a heat sink that is cooled by air flow around the tool and into the axial chamber whereby heat from the cutting edges flows rapidly across the surface 222 to the heat sink.

Figure 9:
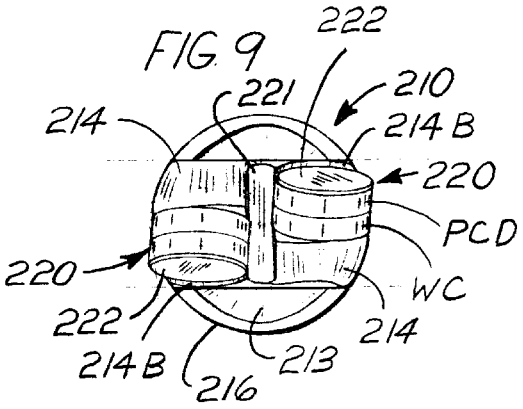
FIG. 9 is a top plan view of the third embodiment of FIG. 6.
Figure 8:
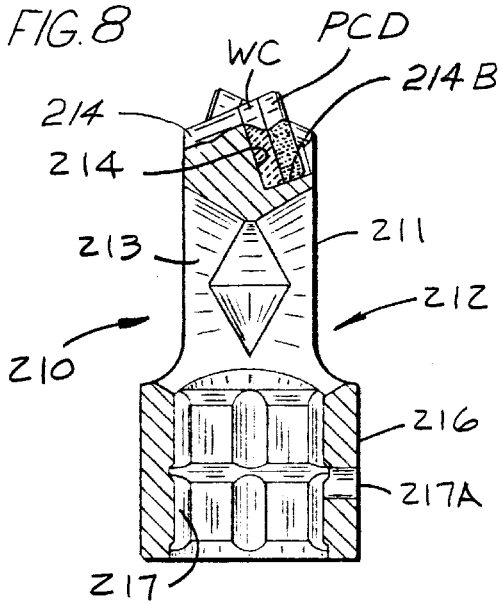
FIG. 8 is a sectional view, similar to FIG. 7, taken substantially along line 8—8 of FIG. 6.
Figure 6:
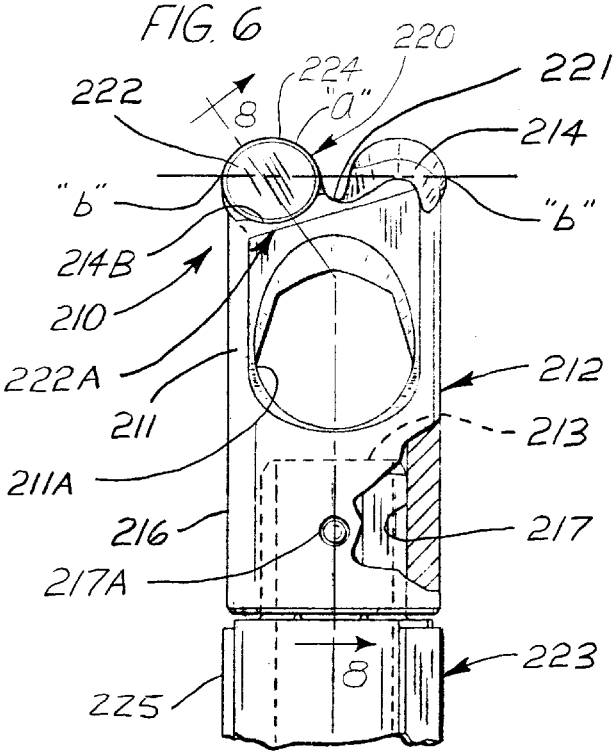
FIG. 6 is a side elevational view, partly broken away, of a third, presently preferred, embodiment of a roof drill bit shown connected to a bit coupler.
Figure 7:
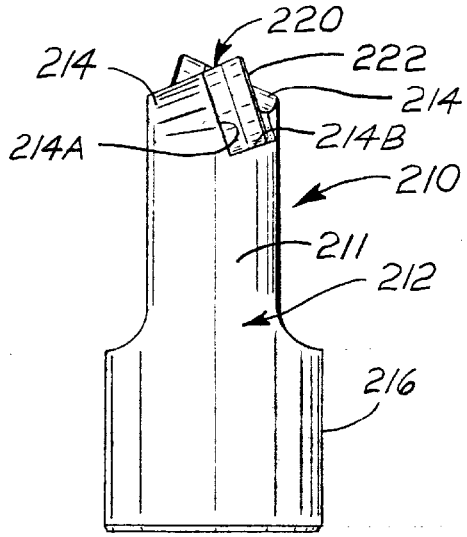
FIG. 7 is a side elevational view of the third drill bit embodiment as rotated 900 from FIG. 6.
Figure 10:
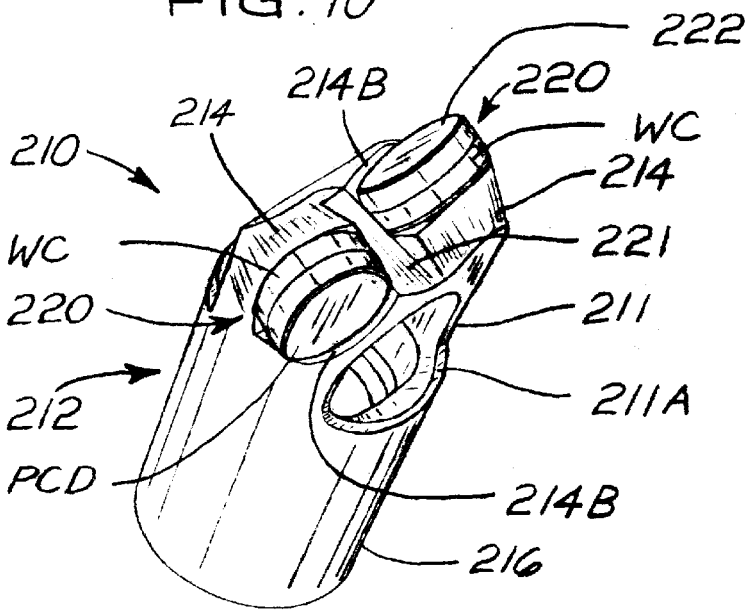
FIG. 10 is a perspective view of the third embodiment.

As indicated, the roof drill bit 210 utilizes a PDC cutting element or insert 220 on each of dual heads 214; this PDC insert having a polycrystalline diamond layer PCD fused as a working wear surface 222 on a carbide base WC which is bonded onto the steel body heads 214. These PCD inserts 220 are in the form of round discs of uniform thickness applied to the oppositely facing surfaces 214A of the dual heads 214. As shown best in FIG. 6, each insert or cutting element has an arcuate cutting edge 224 formed on the wear surface 222 with a high entry point "a" and an outer gauge cutting margin at point "b" to cut the desired bore, and the effective cutting edge 224 actually extends about 15° beyond both point "a" and point "b" to define a cutting arc of approximately 120° presenting continuously compounded radial cutter angles. The drag bit 210 is also constructed and arranged to position its wear faces 222 and cutting edges 224 so as to be in substantially full compression during use, and thus the wear surfaces 222 have a negative rake angle and a negative skew angle. As shown best in FIGS. 7 and 8, each wear surface 222 of tool bit 210 has a preferred negative rake angle in the range of about 10° to 25°, i.e. it lies in a plane that is laid back or open relative to the vertical axis of the tool (as defined by a plane extending normal to the direction of rotation). It is believed that the operative range of negative rake angles useful in such HDC cutting tools is about 5° to 35° and, even more preferably, will be in the narrower range of 15° to 25°. As shown in FIG. 9, each wear surface 222 has a preferred negative skew angle of about 8° relative to the same vertical plane extending across the axis of the tool through the center of the PCD wear surfaces 222 and normal to the horizontal rotational arc, see FIG. 9. The operative range of negative skew angles will be about 0° to 15° and, even more preferably, will be in the range of about 4° to 10°. It will be apparent that a rotary drag bit 210 having a cutting edge (224) with compound cutting angles and a wear surface (222) disposed at a substantive substantial negative rake angle in the range of 5° to 35° and a negative skew angle in the range of 0° to 15° will produce a radial auger-type cutting action rather than a plowing action. The negative rake and skew angles position the wear surface 222 to engage and be opposed by the axial thrust of the drill bit 210 acting against the work surface thereby imparting substantially total compression across the entire wear surface of the insert 220 to firmly compress and maintain it against the body mass of the tool heads 214 to which it is bonded.

It will be understood that the PDC diamond compact 220 of the preferred FIGS. 6–10 embodiment is formed and brazed onto the steel tool body surface 214A with its lower arcuate edge section opposite to the cutting arc 224 being supported by the socket 214B. The tool 210 is then stress relieved using the hot stress relief process of the invention by heating the assembled tool to a low annealing temperature in the range of 500° F. to 900° F. for an optimum time period of one to three hours. This "hot" process can usually be carried out in ambient (air) conditions except at the higher temperatures above 800° F. when oxidation may occur. The diamond insert tool 210 can also be cryogenically treated (after the cool down period of the heat process) by a relatively longer (e.g. 24 hr.) exposure to liquid nitrogen cooling at about −313° F. It may be noted that the tempered steel body 212 of the tool does not lose any substantial tempering by reason of the brazing process in attaching the PDC element to the body even though this brazing process directly causes tension stress in the PDC element. Even so, where the cryo process is used as an added step, it has been found to further toughen the steel body in addition to the cutting elements.

In the operation of the tool 210, as in earth boring operations to bore roof bolting holes of four (4') foot depth or the like in very hard sandstone (e.g. 22000—28000 psi), the preferred drilling parameters for dry vacuum drilling uses rotational speeds in the range of 400 to 650 rpm with axial thrust pressures of about 850 to 1250 psi. These thrust pressures of 850 to 1250 psi are typical hydraulic gauge pressures as read on the drilling machine (such as a New Fletcher roof bolter), and will be used by those skilled in the art to produce a desired thrust force of about 2200 to 4700 pounds exerted by the drill bit against the rock work surface in the bore hole B. Optimum rotation of 400 to 450 rpm with a thrust of about 1100 psi has produced remarkable test results. Earlier testing had indicated that drilling operations should be carried out using a lower range of rotational speeds at much higher thrust pressures but, although good results were obtained, the above parameters produce superior results. Of course, the harder the geological formation (e.g. higher silica content) then the slower the rotational speed should be. Similarly, axial thrust can be a major cause of shearing, breaking and delamination of PDC cutting elements or the like, although more rapid production occurs at greater axial thrust and higher speeds in the absence of tool failure.

It will now be apparent that a novel earth boring tool 210 having superhard circular cutting elements 220 has been designed to work at high productive rates in hard earth conditions using dry vacuum drilling techniques. The tool 210 can be used with either wet or dry cooling and flushing methods, but the advantages of dry vacuum drilling especially in roof top boring—will be readily apparent. The heat break (221) between the spaced PDC cutting elements, together with the heat sink (222A) below and supporting the diamond table of the cutting element (at 214B), work together to rapidly move or translate the body of heat away from the arcuate cutting edges 224 of the PDC inserts and across the face 222 of these inserts to be taken away from the heat sink area through the suction ports 211A. The supporting ledge 214B typically supports the diamond table "PCD" in direct opposition to the thrust forces exerted through the arc of the cutting edges 224 to mitigate against breakage and/or delamination of the diamond table from the substrate. In addition, the stress relief process of the invention greatly enhances the toughness and durability of the HDC tool and its PDC inserts.

It is now apparent that the objects and advantages of the present invention over the prior art have been fully met. Changes and modifications of the disclosed forms and methods of the invention will become apparent to those skilled in the mining tool and related arts, and the invention is only limited to the scope of the appended claims.

What is claimed is:

1. A method of stress relieving earth boring tools having cutter elements made with superhard surface materials, comprising the steps of:

making the cutter element by bonding a superhard material to a substrate and stress relieving the cutter element;

assemblying the cutter element on a boring tool body by brazing said cutter element in situ; and stress relieving the assembled boring tool body and cutter element by subjecting the tool assembly to further heat treatment in the range of about 500° F. to 900° F. for a preselected time period followed by a cool-down period.

2. The method of claim 1 in which the further heat treatment is maintained at a preselected time period in the range of about 1 to 3 hours.

3. The method of claim 2 in which the further heat treatment comprises a hot stress relief step wherein the tool assembly is stress relieved in air at a temperature in the range of about 500° F. to 700° F. for a time period of about 2 to 3 hours.

4. The method of claim 2 in which the further heat treatment comprises a hot stress relief step wherein the tool assembly is stress relieved at a temperature in the range of 550° F. to 850° F. for a time period of about 1.5 to 3 hours.

5. The method of claim 2 in which the further heat treatment comprises a hot stress relief step wherein the tool assembly is stress relieved in an inert atmosphere at a temperature in the range of about 800° F. to 900° F. for a time period of about 1 hours.

6. The method of claim 2 including the additional step of subjecting the tool assembly to a cold treatment after the further heat treatment.

7. The method of claim 6 in which the cold treatment comprises a cryogenic step wherein the tool assembly is stress relieved in a cold zone at a temperature of about −313° F. induced by liquid nitrogen.

8. The method of claim 7 wherein the cryogenic step is carried out for an extended period of about 24 hours.

9. An earth boring tool made according to the method of claim 1.

10. A method of stress relieving earth boring tools having PDC cutter elements with a diamond table bonded to a substrate, comprising the step of annealing the tool and cutter elements in situ by heat treating at a temperature in the range of about 500° F. to 900° F. for a selected time period of about 1 to 3 hours.

11. An earth boring tool made according to the method of claim 10.

12. The method of claim 10 which includes the further step of cooling the annealed tool in a cold zone at a temperature of about −313° F. as induced by liquid nitrogen.

13. An earth boring tool made according to the method of claim 12.

14. An earth boring tool comprising a tool body adapted for cutting rotation, in use, and having a working head portion with plural cutter elements, each of which has a wear surface of superhard material bonded to a substrate and being constructed and arranged for cutting and boring operations in earth formations, and wherein said superhard material and substrate have different thermal coefficient properties creating a stress condition therebetween during bonding, and wherein the cutter elements are stress relieved in situ on the tool body by heat treating at a selected low temperature for a preselected time period.

15. The tool of claim 14 in which the heat treatment comprises hot stress relief at a selected low temperature in the range of about 500°F. to 900° F. for a time period in the range of 1 to 3 hours.

16. The tool of claim 14 in which the cutter elements are further stress relieved in situ on the tool body by cryogenic cooling in a cold zone at about −313° F.

17. The tool of claim 14 in which a pair of circular cutter elements are brazed on said tool body and being constructed and arranged with the wear surfaces facing in the direction of rotation and having outer arcuate cutting edges and lower opposed arcuate margins supported by the tool body.

18. The tool of claim 17, wherein said circular cutter elements are mounted on supporting head masses of the tool body which are spaced apart to effect heat translation during boring operation from the arcuate cutting edges to the opposed arcuate sections.

19. The tool of claim 18, wherein the portions of the tool body supporting the arcuate cutting element sections form heat sinks for receiving the heat generated during boring and translated from the cutting edges to the lower arcuate sections of the cutter elements.

20. The tool of claim 19 which is constructed and arranged for dry vacuum boring operations by having an axially disposed central vacuum chamber in direct communication with said heat sinks.

21. The tool of claim 20 which during dry vacuum boring operations has an optimum rotation speed in the range of 400 to 650 rpm with axial thrust in the range of 850 to 1250 psi.

22. The tool of claim 17 wherein the circular cutter elements are mounted on supporting head masses of the tool body at preselected rake and skew angles relative to the direction of rotation to effect an earth cutting action during boring operations.

23. The tool of claim 22 wherein the circular cutter elements have a negative rake angle in the range of 5° to 35° and a negative skew angle in the range of 0° to 15°.

24. The tool of claim 23 wherein the optimum range of negative rake angles is 15° to 25° and the optimum negative skew angle is 8°.

25. The tool of claim 22, wherein a pair of circular cutter elements are angularly related to each other across the tool and the arcuate cutting edges thereof define a sinusoidal cutting path that is only interrupted by a heat break between these cutter elements.

26. The tool of claim 17 in which the arcuate cutting edges of the cutter elements, in use, cut a bore hole of predetermined gauge, and wherein the tool, in use, is connected for drilling operations to a mounting adapter having reamer means for secondary bore hole gauge maintenance.

27. The tool of claim 14, in which at least two cutter elements are brazed onto the tool body and are constructed and arranged with the wear surfaces facing in the direction of rotation and having outer arcuate cutting edges and lower margins supported by the tool body, and which arcuate cutting edges of the cutter elements, in use, cut a bore hole of predetermined gauge, and wherein the tool, in use, is provided with reamer means for secondary bore hole gauge maintenance.

* * * * *